US007780068B2

(12) United States Patent
Donnelly

(10) Patent No.: US 7,780,068 B2
(45) Date of Patent: Aug. 24, 2010

(54) DISPOSABLE CARRY-OUT FOOD CONTAINER

(76) Inventor: Brian Donnelly, 55 Hunterspoint Rd, Winnipeg, Manitoba (CA) R3R 3B6

( * ) Notice: Subject to any disclaimer, the term of this patent is extended or adjusted under 35 U.S.C. 154(b) by 573 days.

(21) Appl. No.: 11/671,057

(22) Filed: Feb. 5, 2007

(65) Prior Publication Data

US 2007/0194092 A1 Aug. 23, 2007

(30) Foreign Application Priority Data

Feb. 20, 2006 (CA) ..... 2537175

(51) Int. Cl.
*B65D 5/46* (2006.01)
*B65D 25/04* (2006.01)
*B65D 5/00* (2006.01)

(52) U.S. Cl. ..... 229/117.25; 229/143; 229/150; 229/120.24; 229/120.38; 229/120.26

(58) Field of Classification Search ..... 229/117.25, 229/143, 150, 120.24, 120.38, 914, 108, 229/112, 120.26, 120.28, 120.03
See application file for complete search history.

(56) References Cited

U.S. PATENT DOCUMENTS 831,730 A * 9/1906 Miller ..... 217/122
883,855 A * 4/1908 Bloomer ..... 229/117.21
1,171,228 A 2/1916 Misroch et al.
1,697,969 A * 1/1929 Boeye ..... 229/122.26
1,702,921 A * 2/1929 Harrison ..... 229/117.21
1,707,528 A 4/1929 Bombard et al.
1,726,108 A * 8/1929 Hughes ..... 229/120.012
1,894,226 A * 1/1933 Ross ..... 229/143
2,314,491 A * 3/1943 Greenberg ..... 206/587
2,493,176 A * 1/1950 Whitehead ..... 229/146
2,638,262 A * 5/1953 Mulnix ..... 229/117.15
2,719,665 A * 10/1955 Tharpe et al. ..... 229/117.09
2,838,222 A * 6/1958 Papadopoulos ..... 229/117.14
3,373,922 A 3/1968 Watts
3,390,810 A * 7/1968 Schneweiss ..... 206/216
3,700,160 A * 10/1972 Farrell ..... 229/117.25
4,651,919 A * 3/1987 Wischusen, III ..... 229/117
4,747,536 A * 5/1988 Wischusen, III ..... 229/128
4,836,367 A 6/1989 Golkar
4,923,744 A * 5/1990 Peeters ..... 428/34.1

(Continued)

*Primary Examiner*—Gary E Elkins
*Assistant Examiner*—Latrice Byrd
(74) *Attorney, Agent, or Firm*—Ade & Company Inc; Ryan W. Dupuis; Kyle R. Satterthwaite

(57) ABSTRACT

A disposable carry-out food container shaped like a picnic basket. The subject food container has a bottom wall having two side edges extending in a longitudinal direction between opposing ends, two end walls extending upwardly from the bottom wall at the opposing ends respectively, two side walls extending upwardly from the two side edges of the bottom wall to extend in the longitudinal direction between the opposing ends, two lid panels supported on the walls for pivotal movement about respective lateral axes oriented generally perpendicularly to the longitudinal direction between a closed position in which the lid panels enclose an open top end of the container and an open position in which the open top end is substantially unobstructed by the lid panels, and at least one handle coupled at opposing ends on the two side walls respectively such that said at least one handle extends generally in a direction of the lateral axes between the two side walls.

16 Claims, 6 Drawing Sheets

U.S. PATENT DOCUMENTS 5,501,339 A * 3/1996 Suzuki et al. ..... 206/586
6,059,179 A 5/2000 Giampapa
6,422,454 B1 * 7/2002 Barr et al. ..... 229/117.14
6,540,133 B1 * 4/2003 Chou ..... 229/117.22
2004/0188505 A1 * 9/2004 Reagan et al. ..... 229/117.14

* cited by examiner

DISPOSABLE CARRY-OUT FOOD CONTAINER

PRIORITY APPLICATION

This application claims priority from Canada Patent Application Serial No. 2,537,175, filed Feb. 20, 2006.

FIELD OF THE INVENTION

The present invention relates to a carry-out food container formed of disposable materials and more particularly relates to a carry-out food container which generally resembles a picnic basket.

BACKGROUND

Various products are known to be purchased by consumers which require a container for ease of transport. In the food industry, it is common place to place food items in individual containers which are then carried in a bag. This arrangement is desirable because of the disposable nature of the bag and individual containers resulting in a low cost to the producer, but the appearance of the takeout package is somewhat unattractive.

U.S. Pat. No. 1,171,228 to Misroch et al.; U.S. Pat. No. 1,707,528 to Bombard et al.; U.S. Pat. No. 4,836,367 to Golkar; U.S. Pat. No. 6,059,179 to Giampapa; and U.S. Pat. No. 3,373,922 to Watts disclose various examples of disposable containers. None however combine an attractive appearance with suitable strength for carrying a full meal in a disposable carryout container.

SUMMARY OF THE INVENTION

According to one aspect of the invention there is provided a disposable carry-out food container comprising:

a bottom wall having two side edges extending in a longitudinal direction between opposing ends;

two end walls extending upwardly from the bottom wall at the opposing ends respectively;

two side walls extending upwardly from the two side edges of the bottom wall to extend in the longitudinal direction between the opposing ends;

two lid panels supported on the walls for pivotal movement about respective lateral axes oriented generally perpendicularly to the longitudinal direction between a closed position in which the lid panels enclose an open top end of the container and an open position in which the open top end is substantially unobstructed by the lid panels; and at least one handle coupled at opposing ends on the two side walls respectively such that said at least one handle extends generally in a direction of the lateral axes between the two side walls;

the walls, lid panels and said at least one handle being configured to resemble a picnic basket.

By providing a container which is configured to resemble a picnic basket, the container has an attractive appearance while being sufficiently durable, even if made of disposable materials, due to the configuration of the handle being anchored in opposed side walls of the container.

The container is preferably formed of lightweight, disposable and moisture resistant materials.

In a preferred embodiment, an outer surface of the container includes a wicker pattern printed thereon and an inner surface of the container includes a tablecloth type pattern printed thereon.

The side walls preferably increase in height from the end walls to an apex centrally located in the longitudinal direction.

The lid panels are preferably hinged on the end walls respectively and meet one another at a longitudinal center of the container in the closed position.

One of the lid panels may include an integral extension panel having a tongue formed therein which mates with a slot in the other lid panel to latch the lid panels in the closed position.

There may be provided only one handle spanning between the side walls at a longitudinal center of the container.

The handle is preferably formed of a moisture resistant plastic material having greater strength than a material forming the walls of the container. Other suitable materials include reinforced paper, cardboard or various laminated paper type products for example.

The handle may comprise a flat band of a flexible material having respective ends which are mounted flat against the respective side walls.

The handle preferably includes a retainer flange formed at each end thereof for being selectively retained within a mating slot formed in a respective one of the side walls.

There may be provided an upright divider wall supported within an interior of the container which is separate from said at least one handle and which is selectively removable from the interior of the container.

The divider may be supported between the free ends of the lid panels in the closed position of the lid panels.

The divider may include a pair of bottom panels spanning outwardly from opposing sides of the divider to fully span the bottom wall of the container.

When the bottom wall comprises a plurality of panels extending from the walls respectively in an overlapping configuration, preferably an uppermost one of the panels substantially fully spans the bottom wall of the container.

One of the lid panels, the divider or both may include a cut-out suitably shaped for mating with a wine bottle.

According to a second aspect of the present invention there is provided a disposable carry-out food container comprising:

a bottom wall having two side edges extending in a longitudinal direction between opposing ends;

two end walls extending upwardly from the bottom wall at the opposing ends respectively;

two side walls extending upwardly from the two side edges of the bottom wall to extend in the longitudinal direction between the opposing ends, the side walls increasing in height from the end walls to an apex centrally located in the longitudinal direction;

two lid panels supported on the ends walls respectively for pivotal movement about respective lateral axes oriented generally perpendicularly to the longitudinal direction between a closed position in which respectively free ends of the lid panels meet at the apex of the side walls and the lid panels enclose an open top end of the container and an open position in which the open top end is substantially unobstructed by the lid panels; and at least one handle coupled at opposing ends on the two side walls respectively such that said at least one handle extends generally in a direction of the lateral axes between the two side walls;

the walls, lid panels and said at least one handle being formed of lightweight, disposable and moisture resistant materials an outer surface of the container including a wicker pattern printed thereon and an inner surface of the container including a tablecloth type pattern printed thereon;

whereby the container is configured to resemble a picnic basket.

There may be provided an upright divider wall which is separate from said at least one handle and which is supported within an interior of the container between the free ends of the lid panels in the closed position of the lid panels.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
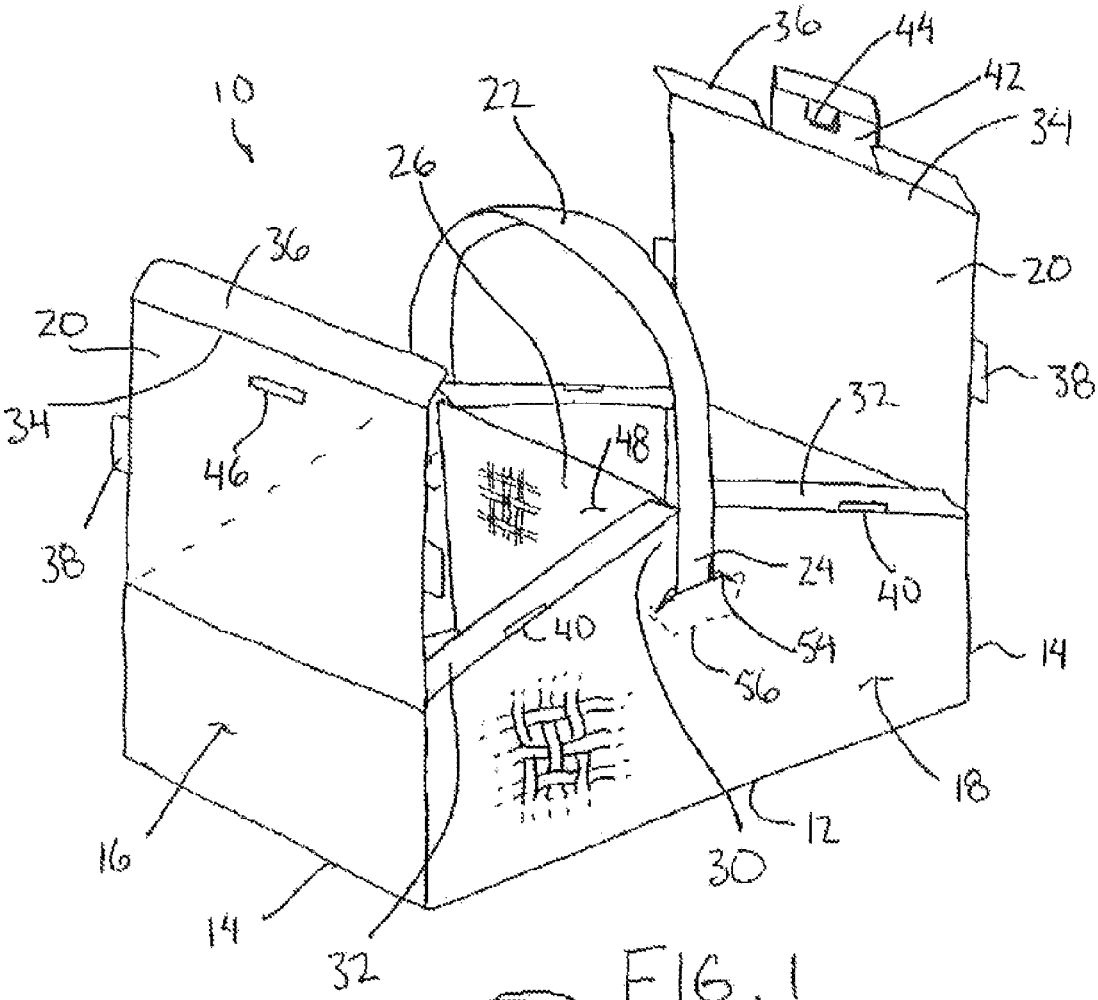
FIG. 1 is a perspective view of a first embodiment of the container in an open position.
Figure 2:
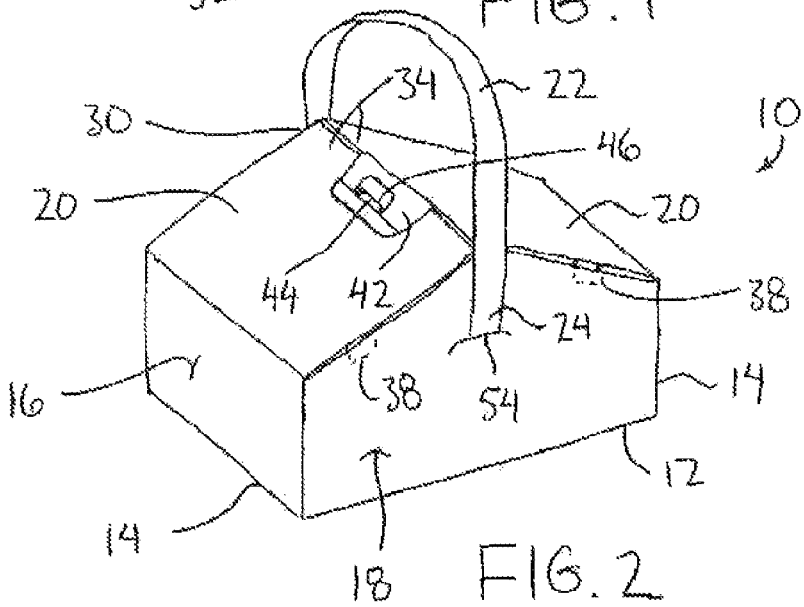
FIG. 2 is a perspective view of the container according to FIG. 1 in a closed position.
Figure 3:
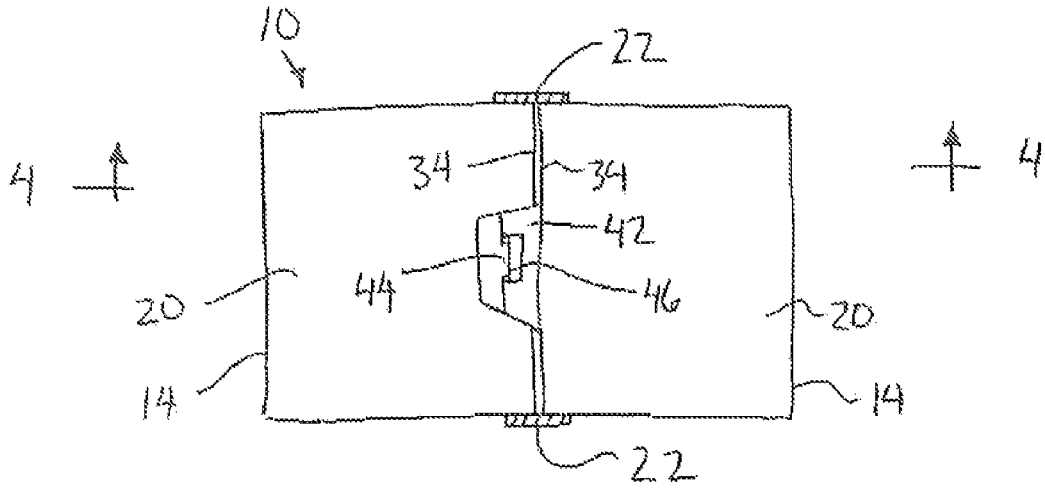
FIG. 3 is a top plan view of the container according to the first embodiment.
Figure 4:
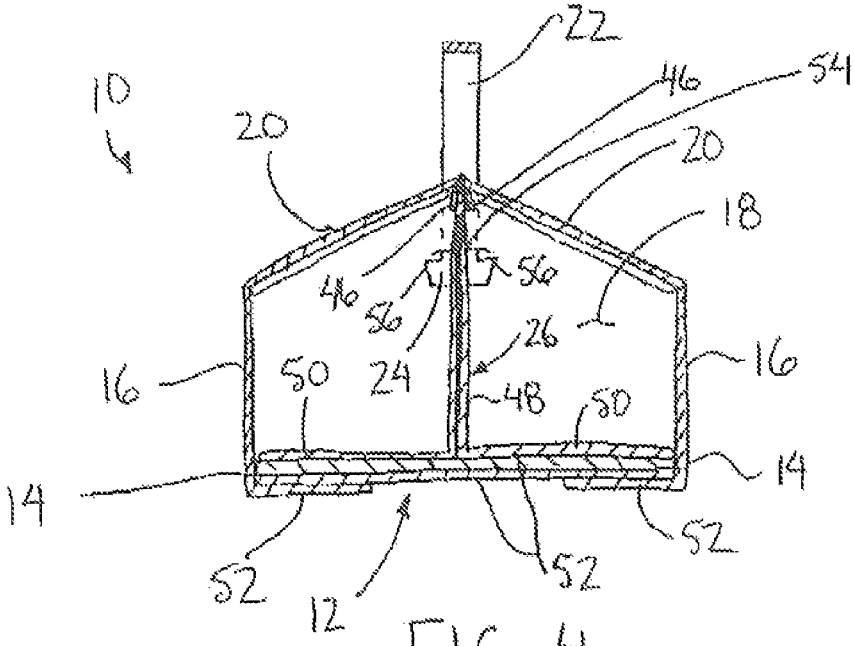
FIG. 4 is a sectional view along the line 4-4 of FIG. 3.
Figure 5:
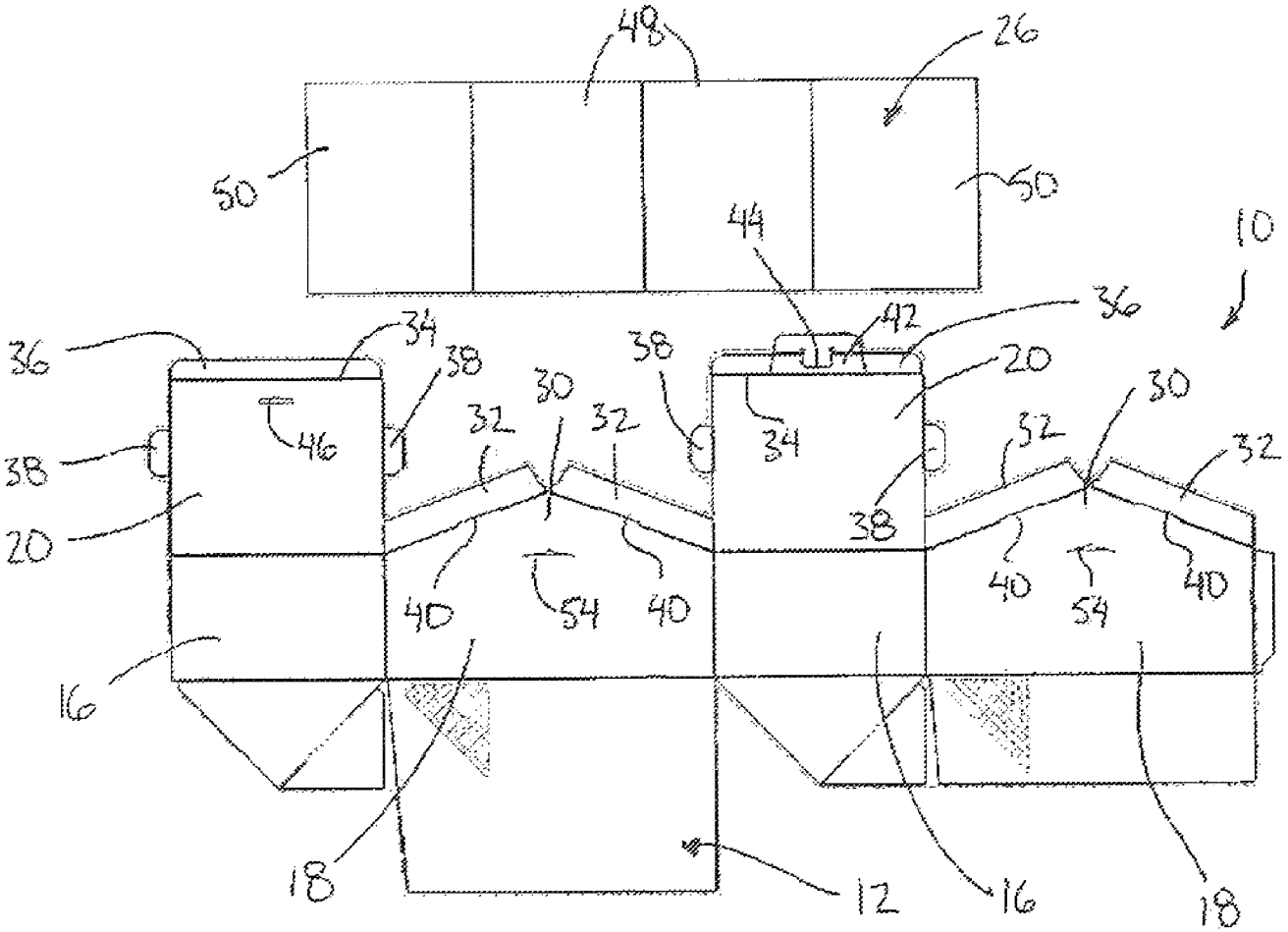
FIG. 5 is a plan view of the container according to FIG. 1 in an unfolded and pre-assembled condition.
Figure 6:
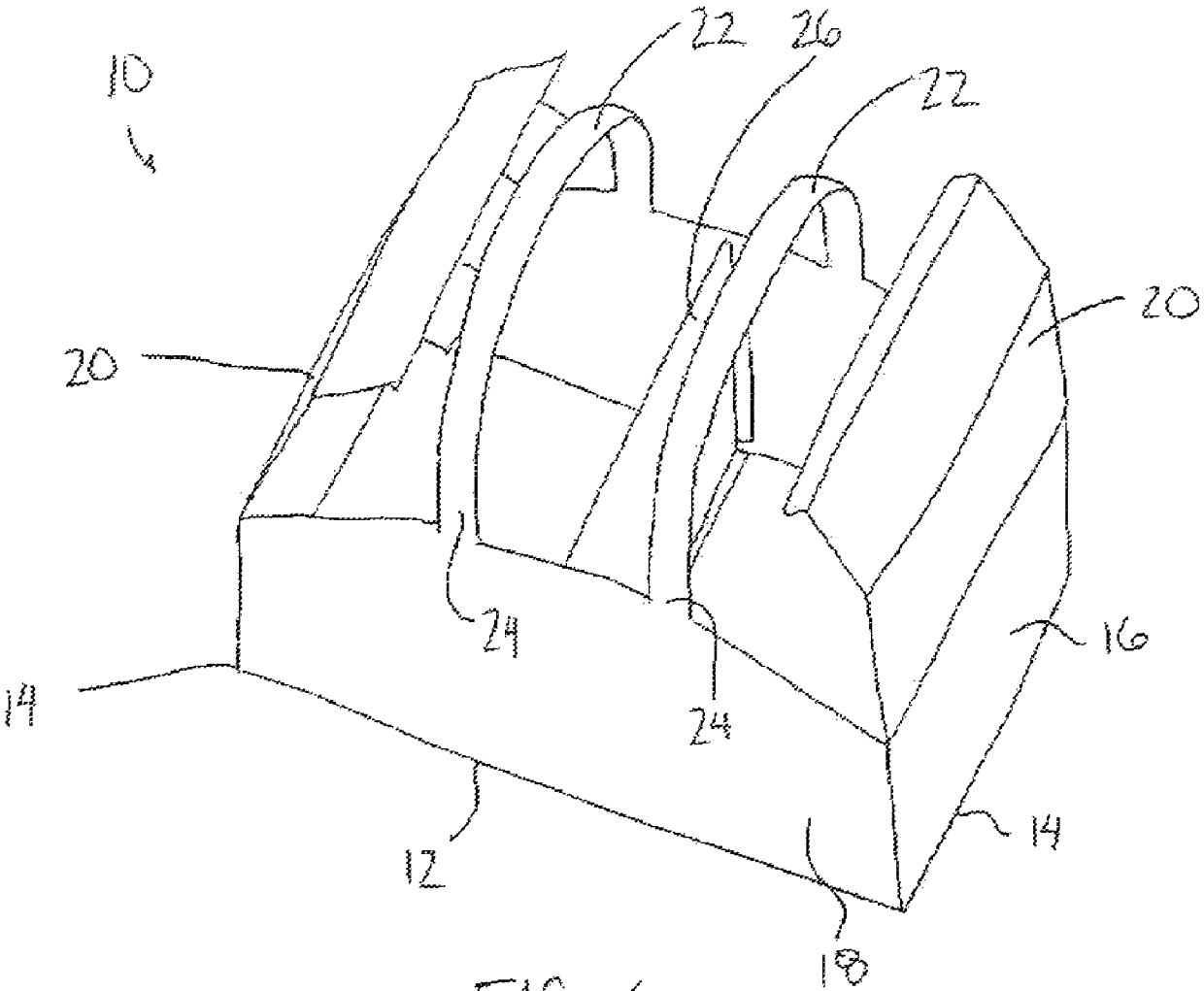
FIG. 6 is a perspective view of a second embodiment of the container.

Referring to the accompanying figures there is illustrated a disposable carryout food container generally indicated by reference numeral 10. Though various embodiments of the container 10 are illustrated in the accompanying specification and drawings, the common features will first be described herein.

The container 10 is formed of lightweight, disposable materials which are moisture resistant and food grade medium with sufficient strength to carry a carryout meal for a few persons, for example a weight in the order of thirty pounds. In a preferred embodiment the container is formed primarily of a solid bleached sulphate material or a similar lightweight cardboard or layered paper like material which is sufficiently rigid to maintain its shape in a folded condition. Lightweight corrugated materials may also be employed or various types of plastic materials which perform the same function.

The container includes a rectangular bottom wall 12 which is elongate, having side edges extending in a longitudinal direction between opposed ends 14 of the container. An end wall 16 extends upwardly at each of the ends 14 which is also generally rectangular and which is oriented in a vertical orientation to be parallel to the other end wall in the assembled condition of the container. The container also includes side walls 18 which extend upwardly in a vertical orientation from the respectively side edges of the bottom wall 12 so as to be vertically oriented parallel to one another and extending in the longitudinal direction between the ends 14.

The container further includes two lid panels 20 each of which spans half of the open top end of the container to enclose the open top end in the closed position of the lid panels. Each of the lid panels is generally rectangular and the two panels are substantially equal in dimension so that each spans from one of the ends 14 of the container to a longitudinal center where the panels meet. Each of the panel is hinged about a respective lateral axis which is oriented perpendicular to the longitudinal direction and parallel to the lateral axis of the opposed lid panel 20.

A handle 22 is provided comprising a flat band of flexible material. The handle is preferably formed of a plastic material which is stronger than the material forming the walls of the container, but can be formed of various other materials as noted above with regard to the container walls. The opposed ends 24 of the handle are anchored on the side walls 18 of the container respectively so that the ends of the flat band lie flat, flush and parallel against the side panels. A main portion of the handle extending between the opposed ends 24 extends generally in a lateral direction parallel to the lateral axis of the lid panels and perpendicular to the longitudinal direction.

A central divider 26 is provided within the interior of the container and which is formed separately form the handle 22. The divider 26 is arranged to support a bottle within the interior of the container, or alternatively divides the interior into multiple compartments.

At least portions of both the inner and outer surfaces of the container include a printed image thereon. In a preferred embodiment to further resemble a picnic basket, the exterior of the walls and lid panels are printed with a wicker pattern, or alternatively a gingham pattern. The divider 26 or other interior surfaces of the container is provided with a tablecloth like pattern in the preferred embodiment or a gingham pattern for example. In alternate embodiments, the printed images on both the inner and outer surfaces of the container may simply be provided with advertising information or other attractive patterns to decorate both the inner and outer surfaces. When the divider is provided as a removable component, the divider may be printed with one image while the exterior of the walls and lid panels are provided with a different printed image so that any particular component of the container only requires printing in a single side thereof in a single pattern.

Turning now to FIG. 1 through 5, the first embodiment will now be described in further detail. In the first embodiment, the side walls 18 increase in height from the ends 14 to a central apex 30 so that the top edge of the side walls slopes upwardly and inwardly towards the central apex 30. A side flange 32 is provided along the top edges of both side walls, with the flanges being interrupted at the apex so that the flanges may be folded relative to the side walls 18 to project inwardly slightly for overlapping by the lid panels 20 in the closed position.

The lid panels 20 in the first embodiment are hinged along the full width of the top end of the end walls 16 to project inwardly to respective free edges 34 which meet with one another at the central apex 30 of the side walls. An edge flange 36 is provided at the free edge 34 of both lid panels so that when the free edges 34 meet with one another, the edge flanges 36 of both lid panels overlap one another and extend downwardly parallel and abutted with one another when the lid panels are in the closed positions. Each lid panel 20 includes a pair of tongues 38 formed as projections of opposing side edges thereof spaced partway between the hinge and the free edge 34 for being folded to extend generally downwardly from the lid panel in the closed position and to be received within a mating slot 40 formed on the respective side flange 32 of the side walls 18.

In the first embodiment a latch is also provided in the form of extension panel 42 integrally supported and formed on one of the lid panels 20 for latching engagement with the other lid panel to secure the lid panels in the closed position. The extension 42 interrupts the edge flange 36 to split the edge flange into two separate parts on the respective lid panel 20 supporting the extension panel 42 thereon.

The extension panel 42 includes a U-shaped slot which forms a tongue 44 extending from the extension panel 42 back towards the respective lid panel upon which it is supported for mating engagement within a respective slot 46 located in the other lid panel 20. All of the components of the latch including the extension panel and the reverse tongue 44 are cut from a single blank of material along with the lid panels 20 so that no additional fasteners are required to secure the lid panels together.

Also in the first embodiment, the divider 26 comprises a vertical wall 48 which extends a full height of the interior of the container from the bottom to the central apex of the side walls. A top edge of the vertical wall 48 of the divider is thus received between the edge flanges 36 of the two lid panels so that the divider and the edge flanges are all abutted against one another to lie parallel and flush with one another. The edge flanges 36 serve to maintain the divider in a vertical orientation in the closed position of the container.

The divider further includes a pair of bottom panels 50 spanning laterally outwardly form opposing sides of the vertical wall 48 at the bottom end thereof to fully span the bottom of the interior of the container. The vertical wall 48 and the bottom panels 50 of the divider are all formed of a single rectangular piece of material such that the vertical wall comprises two layers of material which are folded relative to one another at the top edge of the vertical wall with the bottom panels 50 being formed integrally with respective ones of the two layers forming the vertical wall portion so that each panel 50 meets one of the layers of the vertical portion at a respective fold at the bottom end of the vertical wall portion.

In the first embodiment, the bottom 12 of the container is formed in multiple folded layers comprising a panel extending inwardly from each of the end and side walls to overlap one another when folded into an assembled position of the container. An uppermost one of the panels 52 forming the bottom of the container is generally rectangular and has dimensions to substantially span the full bottom of the container so that the interior surface of the container at the bottom is substantially seamless for added strength and for an attractive finished appearance.

In the first embodiment only a single handle 22 is provided which is longitudinally centered to extend in the lateral direction between the apexes of the opposing side walls. Each side wall is provided with a horizontal slot at the apex which is only slightly wider than the band of material forming the handle for receiving an end of the handle through each slot 54. The ends of the handle are each provided with a pair of retainer flanges 56 projecting outwardly from both sides of the band of material to increase the width of the band of material in both directions. The length of the slots 54 is arranged to be approximately equal to the width of the band forming the main portion of the handle in addition to the width of one of the retainer flanges 54 to permit insertion of the end of the handle into the slot but to restrict removal once both of the flanges have been inserted through the slots 54 as the overall width of the band including the flanges is greater than the length of the slots 54.

Turning now to the second embodiment, the container may be provided with two handles 22 each of which is similarly anchored between the opposing side walls. When two handles are provided each are approximately equally spaced from the longitudinal center. In an alternative mounting arrangement, the ends of the handles may instead span the full height of the side walls while being bonded to the side walls along the full length thereof to provide adequate strength for securing the handles to the walls. The divider 26 in the illustrated second embodiment comprises only a single panel having mounting flanges about a periphery thereof which are folded perpendicular to the panel and bonded to the respective sides and bottom of the container to be adequately fixed in place.

Figure 7:
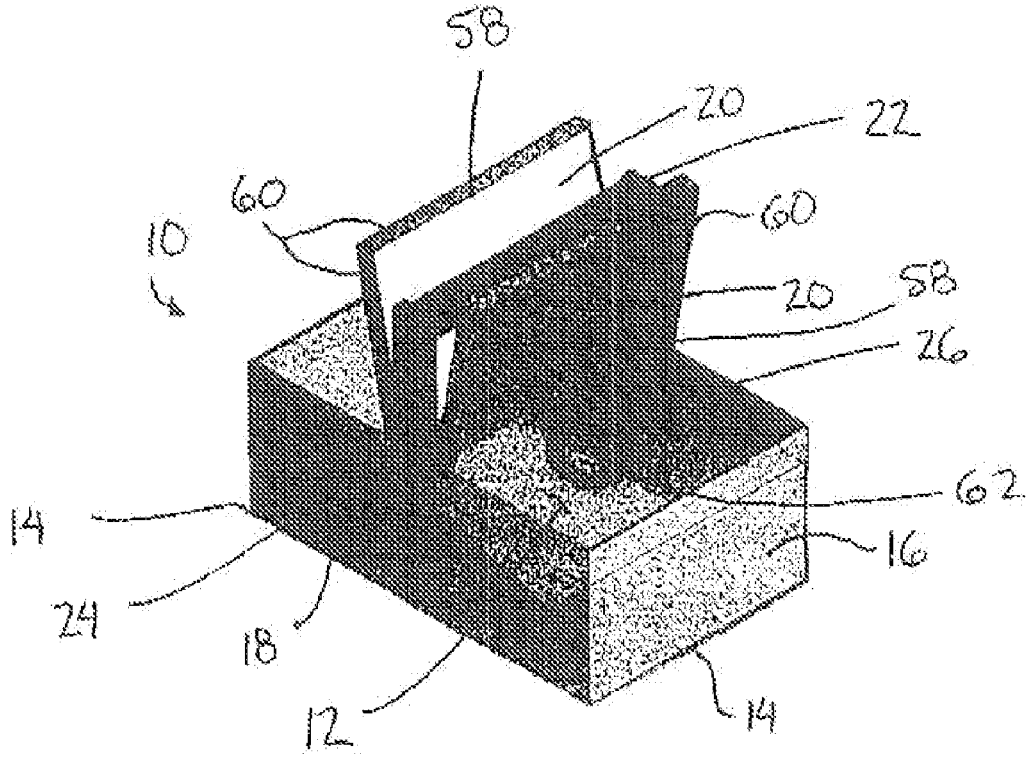
FIG. 7 is a perspective view of a third embodiment of the container.

Turning now to FIG. 7, in a further embodiment the lid panels 20 are hinged at a longitudinal center of the container to span outwardly to respective free edges 58 located at the opposed ends 14 of the container. A depending peripheral flange 60 is provided about a periphery of the lid panels for overlapping the side walls and end walls when the lid panels are in the closed. In the embodiment of FIG. 7, the handle comprises a rigid plastic member mounted at a longitudinal center with the ends being flush mounted against the opposing side walls. The handle is provided with an integrally formed strap 62 which is located at the interior of the container and which is suitably sized for receiving a bottle therethrough so that the weight of a wine bottom for example may be carried by the handle directly. The remaining items in the container, in this instance, are supported by the walls of the container which are in turn suspended from the handle so as to indirectly support the remaining items in the container on the handle.

Figure 8:
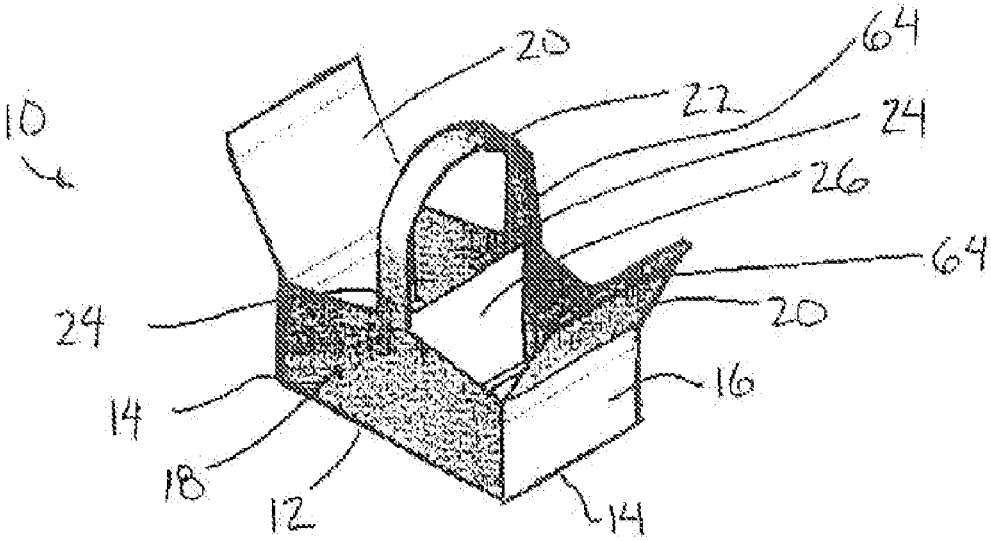
FIG. 8 is a perspective view of a fourth embodiment of the container.

Turning now to FIG. 8, in a further embodiment the handle may be integrally formed with the side walls of the container of a similar material. In this embodiment, the handle 22 is provided with reinforcing strips 64 which line the interior of the handle to extend the full length thereof and to extend beyond the ends of the handle and also overlap the interior surfaces of the side walls along the full height thereof for adequately securing the handle to the side walls.

Figure 9:
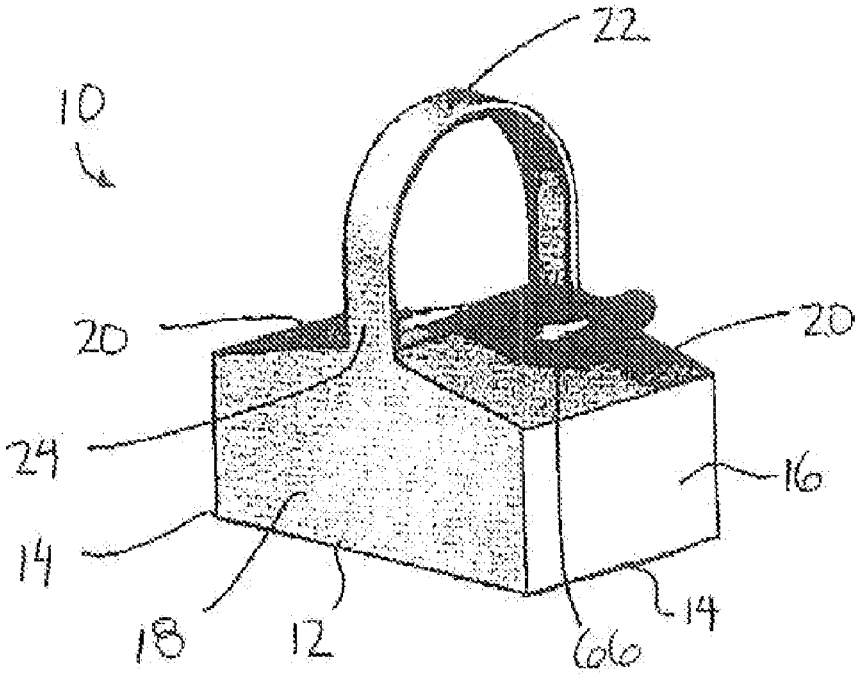
FIG. 9 and FIG. 10 are perspective views of a further embodiment of the container in respective closed and open positions.
Figure 10:
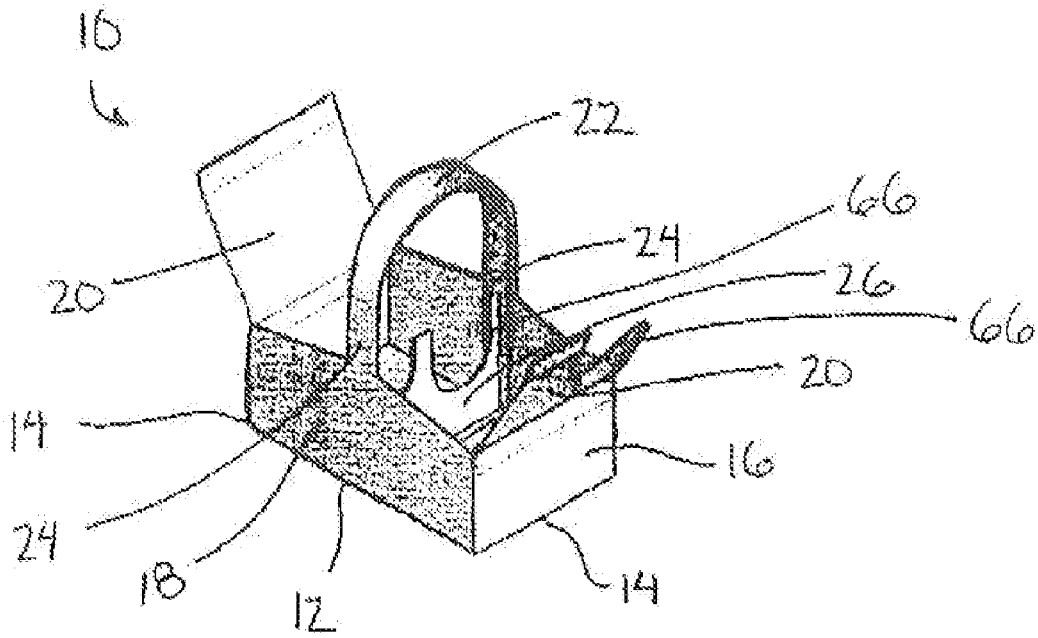

As shown in the illustrated embodiment of FIGS. 9 and 10, the divider 26 and one of the lid panels 20 are each provided with a cut-out opening 66 which is suitably arranged for mating with a cylindrical container, for example a wine bottle. The bottle is supported so that it projects from a base supported in the compartment of one half of the interior of the container, through the cut out in the divider which supports it, to an upper free end of the bottle which projects through the cut-out in the lip panel to the exterior of the container when the lid panels are in the closed position.

The cut-outs 66 may be provided as simply a perforated outline filled with a solid panel of material integrally formed with the respective lid panel or divider so that the panel is only removed by punching out when required. Punch-outs or cut-outs 66 may be provided in any of the embodiments where an additional container, for example a wine bottle, is desired to be positioned to project through the lid panel or is desired to be additionally supported by the divider. Each of the cut-outs 66 generally comprises a U-shaped opening, which in the case of the divider is open to the top free edge of the divider, and in the case of the lid panel is open to the free inner edge of the lid panel.

Regardless of which embodiment of the container, the most typical materials for manufacture comprise a pressed paper board, a corrugated cardboard, a single thickness plastic or a corrugated plastic board. For containers carrying heavier weights, for example fruit or bottles etc., the material is typically a laminated or corrugated cardboard because it is heavier and stiffer than a single thickness board.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A disposable carry-out food container comprising:

a bottom wall having two side edges extending in a longitudinal direction between opposing ends;

two end walls extending upwardly from the bottom wall at the opposing ends respectively;

two side walls extending upwardly from the two side edges of the bottom wall to extend in the longitudinal direction between the opposing ends, the side walls increasing in height from the end walls to an apex centrally located in the longitudinal direction;

two lid panels supported on the ends walls respectively for pivotal movement about respective lateral axes oriented generally perpendicularly to the longitudinal direction between a closed position in which respective ends of the lid panels meet at the apex of the side walls and the lid panels enclose an open top end of the container and an open position in which the open top end is substantially unobstructed by the lid panels; and at least one handle coupled at opposing ends on the two side walls respectively independently of the lid panels such that said at least one handle extends generally in a direction of the lateral axes between the two side walls;

each of the side walls including a side flange along a top edge thereof which is interrupted at the apex, the side flanges being folded relative to the side walls to project inwardly so as to be arranged to be overlapped by the lid panels in the closed position thereof;

each of the lid panels comprising a pair of tongues formed as projections on opposing side edges of the lid panel so as to be arranged extend downwardly into a respective one of a plurality of mating slots formed in the side flanges of the side walls in the closed position of the lid panels;

each of the lid panels further comprising an edge flange along the ends thereof such that the edge flanges are arranged to extend downwardly from the apex in parallel abutting relation in the closed position of the lid panels;

one of the lid panels further comprising a latching slot formed therein;

the other one of the lid panels further comprising an extension panel extending from the ends of the lid panel such that the corresponding edge flange comprises two separate portions interrupted by the extension panel;

the extension panel including a U-shaped slot formed therein so as to define a tongue oriented to extend from the extension panel towards the lid panel which supports the extension panel thereon such that the tongue is arranged for mating engagement within the latching slot;

the walls, lid panels and said at least one handle being configured to resemble a picnic basket.

2. The container according to claim 1 wherein the container is formed of lightweight, disposable and moisture resistant materials.

3. The container according to claim 1 wherein both an inner side and an outer side of the container are provided with a printed image thereon.

4. The container according to claim 1 wherein an outer surface of the container includes a wicker pattern printed thereon.

5. The container according to claim 1 wherein an inner surface of the container includes a tablecloth type pattern printed thereon.

6. The container according to claim 1 wherein there is provided only one handle spanning between the side walls at a longitudinal center of the container.

7. The container according to claim 1 wherein the handle is formed of a moisture resistant plastic material having greater strength than a material forming the walls of the container.

8. The container according to claim 1 wherein the handle comprises a flat band of a flexible material having respective ends which are mounted flat against the respective side walls.

9. The container according to claim 1 wherein the handle includes a retainer flange formed at each end thereof for being selectively retained within a mating slot formed in a respective one of the side walls.

10. The container according to claim 1 wherein there is provided an upright divider wall supported within an interior of the container which is separate from said at least one handle and which is selectively removable from the interior of the container.

11. The container according to claim 1 wherein there is provided an upright divider wall supported within an interior of the container which is supported between the ends of the lid panels in the closed position of the lid panels.

12. The container according to claim 1 wherein there is provided an upright divider wall supported within the container which is selectively removable from the container and which includes a pair of bottom panels spanning outwardly from opposing sides of the divider to fully span the bottom wall of the container.

13. The container according to claim 1 wherein the bottom wall comprises a plurality of panels extending from the walls respectively in an overlapping configuration, wherein an uppermost one of the panels substantially fully spans the bottom wall of the container.

14. The container according to claim 1 wherein one of the lid panels includes a cut-out suitably shaped for mating with a bottle.

15. The container according to claim 1 wherein there is provided an upright divider wall supported within an interior of the container and wherein there is provided a cut-out formed in the divider which is suitably shaped for receiving a bottle therein.

16. The container according to claim 1 wherein there is provided an upright divider wall arranged to be supported within an interior of the container;

the upright divider wall being separate and independent from said at least one handle;

the upright divider wall being selectively removable from the interior of the container;

the upright divider wall being supported at a top end between the ends of the lid panels in the closed position of the lid panels; and the upright divider wall being formed integrally at a bottom end with a pair of bottom panels spanning outwardly from opposing sides of the upright divider wall so as to be arranged to fully span the bottom wall of the container.

* * * * *